US011850725B2

(12) United States Patent
Chang

(10) Patent No.: US 11,850,725 B2
(45) Date of Patent: Dec. 26, 2023

(54) TOOL STORING DEVICE

(71) Applicant: CHUN NIEN PLASTIC LTD., Taichung (TW)

(72) Inventor: Chi-Tsai Chang, Taichung (TW)

(73) Assignee: CHUN NIEN PLASTIC LTD., Taichung (TW)

( * ) Notice: Subject to any disclaimer, the term of this patent is extended or adjusted under 35 U.S.C. 154(b) by 0 days.

(21) Appl. No.: 17/841,126

(22) Filed: Jun. 15, 2022

(65) Prior Publication Data

US 2023/0182280 A1 Jun. 15, 2023

(30) Foreign Application Priority Data

Dec. 9, 2021 (TW) ..... 110214688

(51) Int. Cl.
*B25H 3/00* (2006.01)

(52) U.S. Cl.
CPC ..... *B25H 3/003* (2013.01)

(58) Field of Classification Search
CPC ..... B25H 3/003; B25H 3/00; B25B 13/06; B25B 12/56; B25B 21/00; B25B 23/0035; B25B 23/0014
USPC ..... 211/70.6, 13.1, 4, 94.01; 206/378, 349, 206/372, 806, 493, 376, 379, 1.5
See application file for complete search history.

(56) References Cited

U.S. PATENT DOCUMENTS 3,239,069 A * 3/1966 Hollins ..... A47K 5/02 206/385
6,092,655 A * 7/2000 Ernst ..... B25H 3/06 206/378
6,168,018 B1 * 1/2001 Ramsey ..... B25H 3/06 206/378
6,886,791 B2 * 5/2005 Dettorre ..... B63B 32/83 211/94.01
7,118,406 B2 * 10/2006 Mu ..... H01R 25/142 211/70.6
8,387,791 B2 * 3/2013 Huang ..... B25H 3/022 206/378
8,499,935 B2 * 8/2013 Hsieh ..... B25H 3/04 206/349
9,138,890 B2 * 9/2015 Lee ..... B25H 3/003
9,527,206 B1 * 12/2016 Hsieh ..... B25H 3/04
11,091,778 B2 * 8/2021 Winnard ..... A61K 39/12
11,358,271 B2 * 6/2022 Chang ..... B25H 3/003
(Continued)

FOREIGN PATENT DOCUMENTS

TW I273006 2/2007
TW I643698 12/2018
TW I661912 6/2019

*Primary Examiner* — Steven A. Reynolds
*Assistant Examiner* — Prince Pal
(74) *Attorney, Agent, or Firm* — Muncy, Geissler, Olds & Lowe, P.C.

(57) ABSTRACT

A tool storing device is provided, including: a base, including a mounting side; and at least one positioning seat, including a connecting portion, an extension portion and a positioning portion, the connecting portion being connected to the mounting side, the extension portion being protrusive from the connecting portion, the extension portion including an inclined surface inclined to the mounting side, the inclined surface and the mounting side defining an included angle therebetween, the positioning portion being disposed on the inclined surface and configured for assembling of at least one tool.

1 Claim, 6 Drawing Sheets

(56) References Cited

U.S. PATENT DOCUMENTS

| | | | | |
|---|---|---|---|---|
| 2005/0221664 | A1* | 10/2005 | Winnard | B25H 3/003 439/510 |
| 2006/0254940 | A1* | 11/2006 | Mu | B25H 3/003 206/378 |
| 2009/0001111 | A1* | 1/2009 | Lin | B25H 3/003 224/245 |
| 2012/0061339 | A1* | 3/2012 | Chang | B65D 73/0064 211/70.6 |
| 2015/0165615 | A1* | 6/2015 | Lee | B25H 3/003 206/349 |
| 2016/0096264 | A1* | 4/2016 | Kao | B25H 3/06 206/378 |
| 2016/0265596 | A1* | 9/2016 | Yu | F16D 3/185 |
| 2019/0091842 | A1* | 3/2019 | Chou | B25B 13/06 |
| 2020/0101590 | A1* | 4/2020 | Winnard | A61K 39/12 |
| 2020/0198118 | A1* | 6/2020 | Wang | B25B 13/56 |
| 2022/0097223 | A1* | 3/2022 | Chang | B25H 3/003 |

* cited by examiner

TOOL STORING DEVICE

BACKGROUND OF THE INVENTION

Field of the Invention

The present invention relates to a tool storing device.

Description of the Prior Art

Tools are often used to drive members to be driven, such as screws, nuts or the like. Because the members to be driven are of various sizes (or of the metric and imperial systems), it is necessary to prepare tools corresponding to members to be driven of various sizes. It is understandable that a large number of tools need to be placed and stored according to their sizes; otherwise it will be troubled when in use or not in use. Therefore, some storing racks and storage devices, such as those disclosed in TW 1661912, TW 1643698 and TW 1273006, are developed.

However, the tool storage devices disclosed in the above-mentioned patents are only suitable for simple cylindrical sockets but not suitable for tools of large size or special configuration (such as crowfoot wrench). The capacity of the conventional tool storage device for storing tools of large size or special configuration will drop sharply, resulting in the need for users to purchase multiple sets of tool storage devices.

The present invention is, therefore, arisen to obviate or at least mitigate the above-mentioned disadvantages.

SUMMARY OF THE INVENTION

The main object of the present invention is to provide a tool storing device which is capable of storing more tools and has a short length.

To achieve the above and other objects, the present invention provides a tool storing device is provided, including: a base, including a mounting side; and at least one positioning seat, including a connecting portion, an extension portion and a positioning portion, the connecting portion being connected to the mounting side, the extension portion being protrusive from the connecting portion, the extension portion including an inclined surface inclined to the mounting side, the inclined surface and the mounting side defining an included angle therebetween, the positioning portion being disposed on the inclined surface and configured for assembling of at least one tool.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
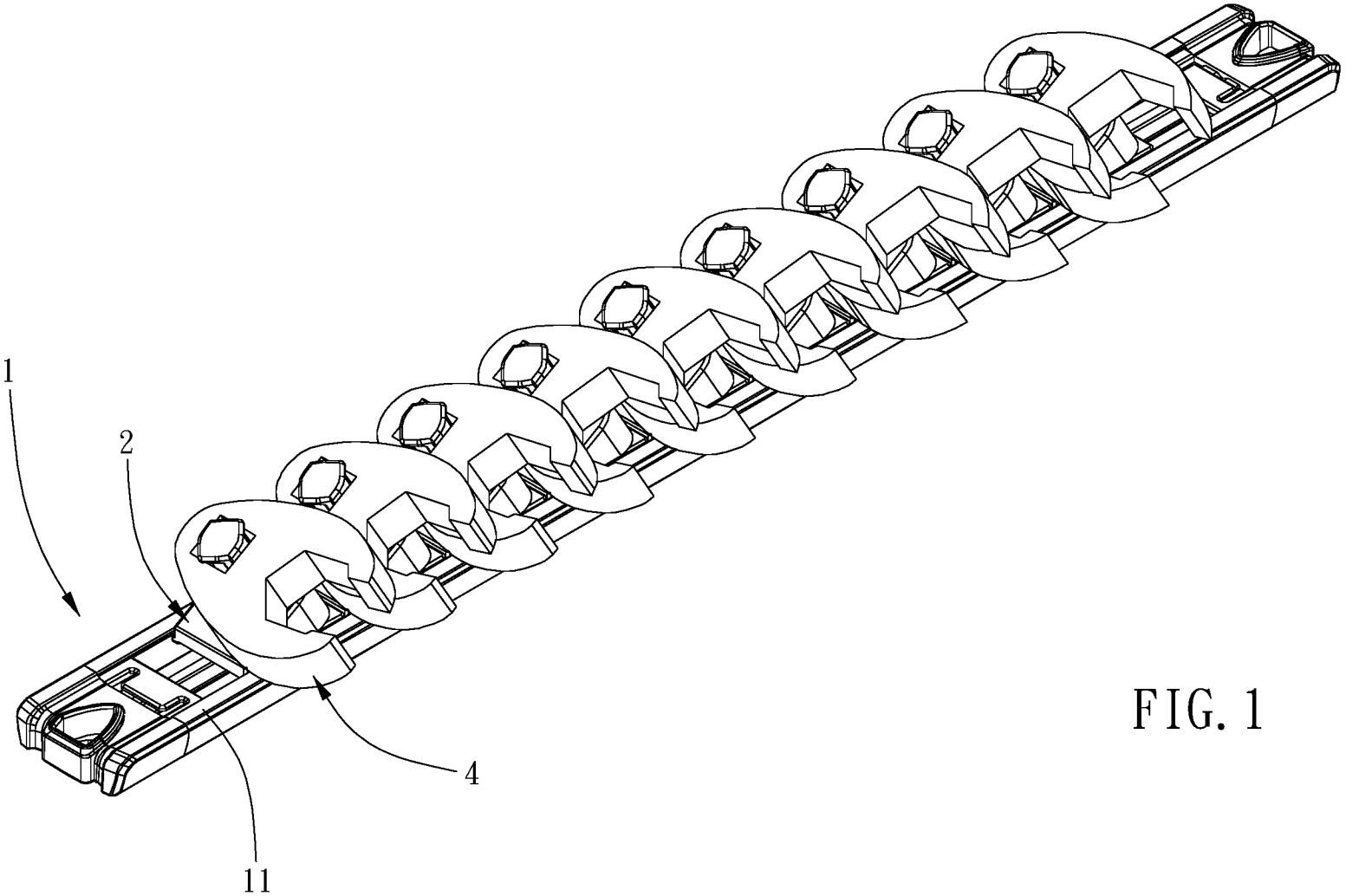
FIG. 1 is a stereogram of a preferable embodiment of the present invention.
Figure 2:
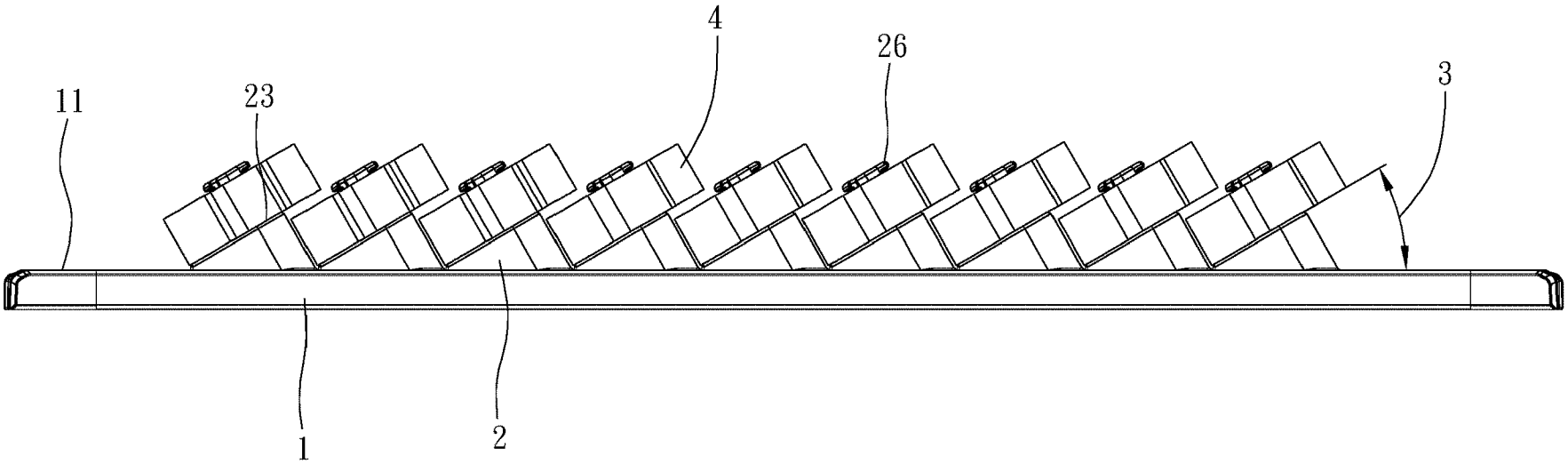
FIG. 2 is a side view of FIG. 1.
Figure 3:
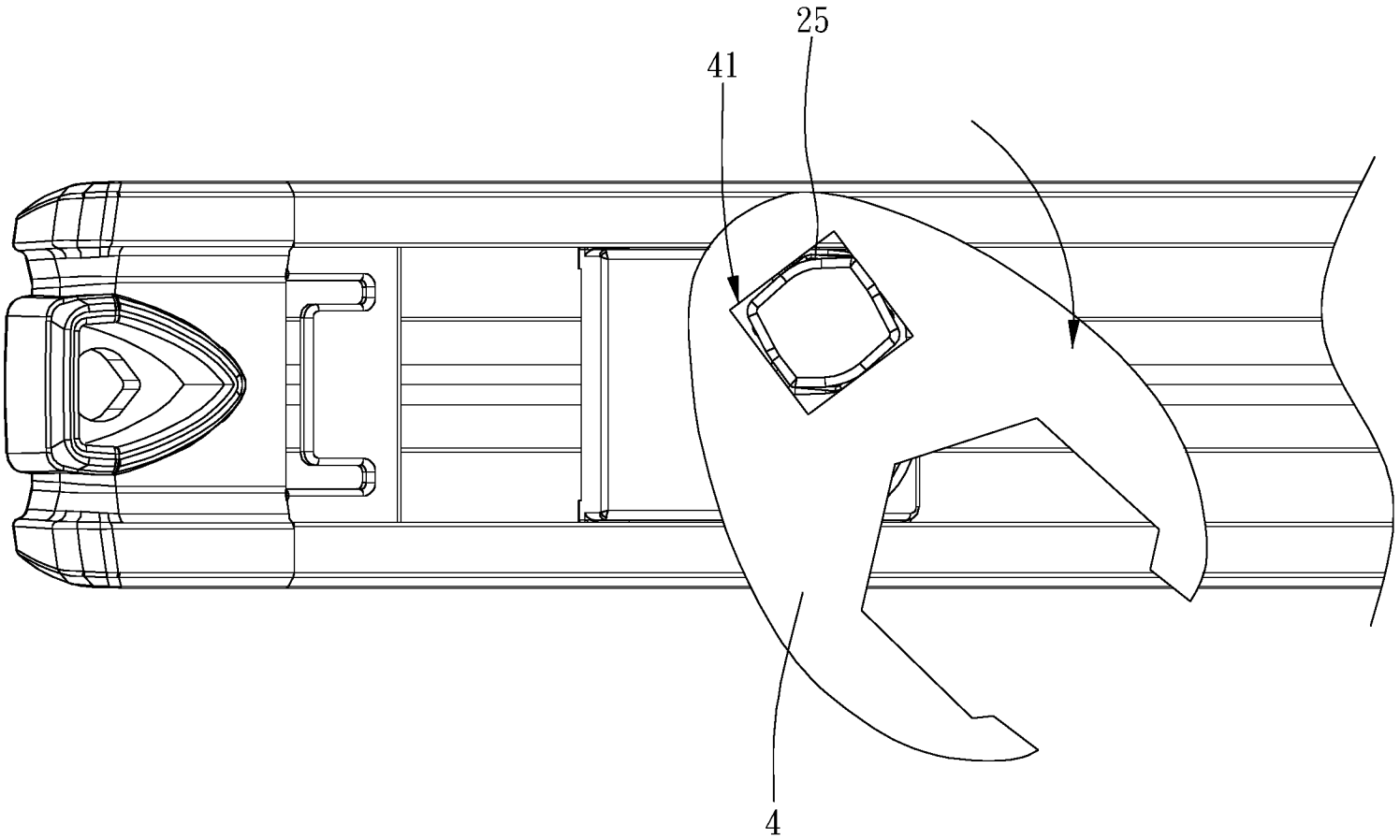
FIGS. 3 and 4 are drawings showing assembling of a tool to a tool storing device of a preferable embodiment of the present invention.
Figure 4:
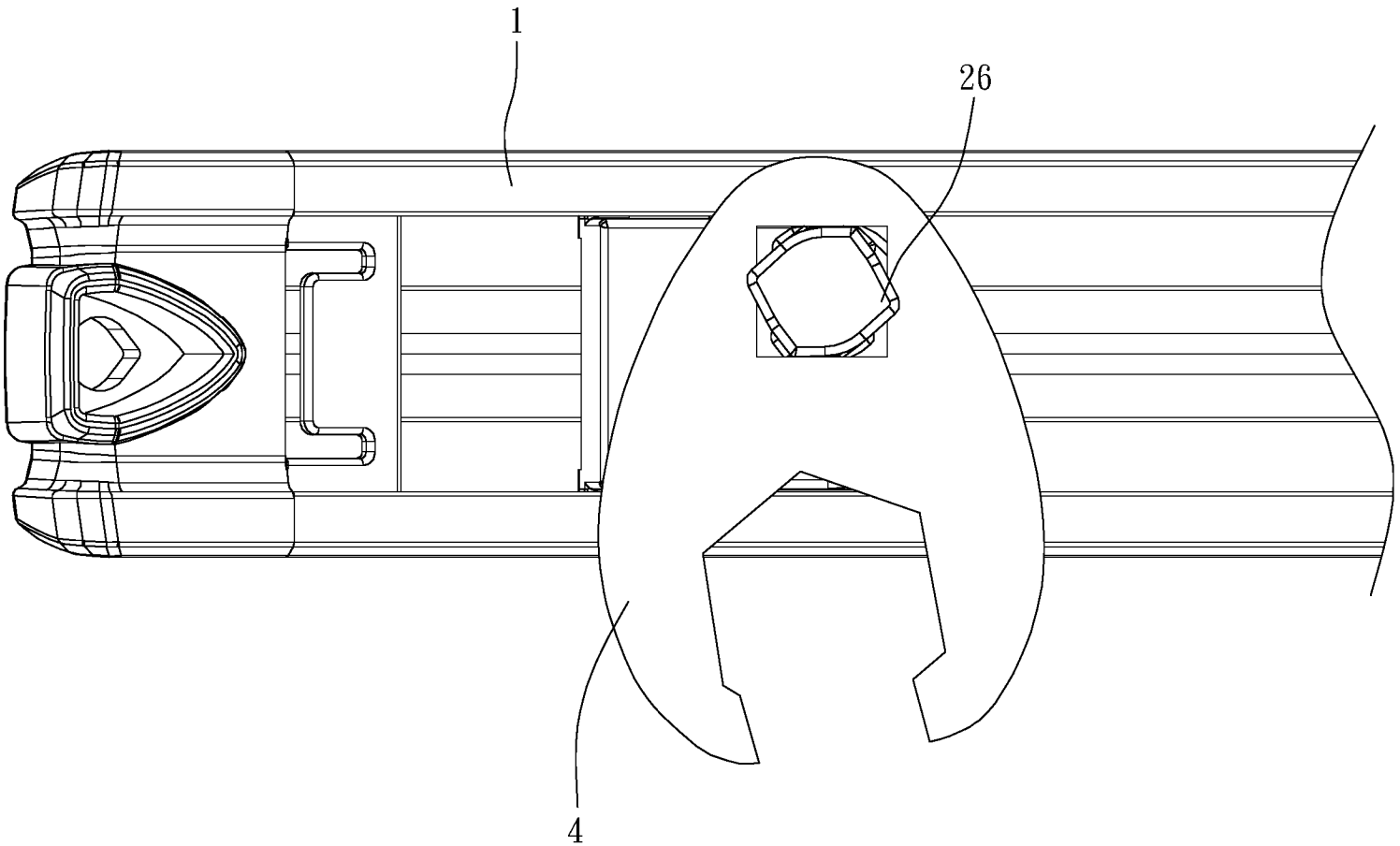
Figure 5:
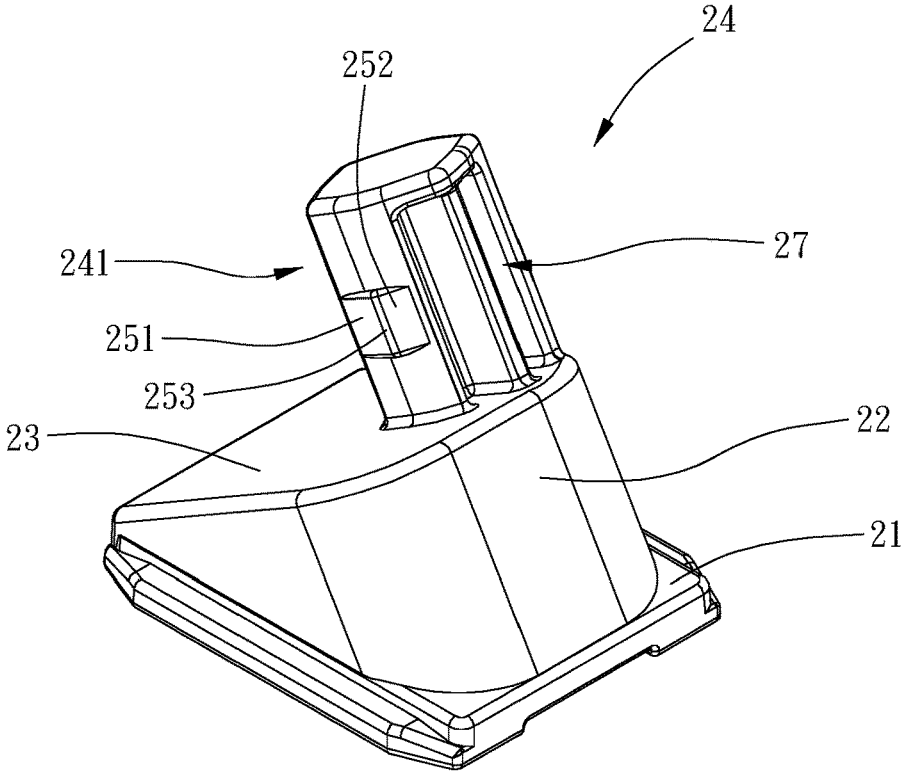
FIG. 5 is a stereogram of a positioning seat of a preferable embodiment of the present invention.
Figure 6:
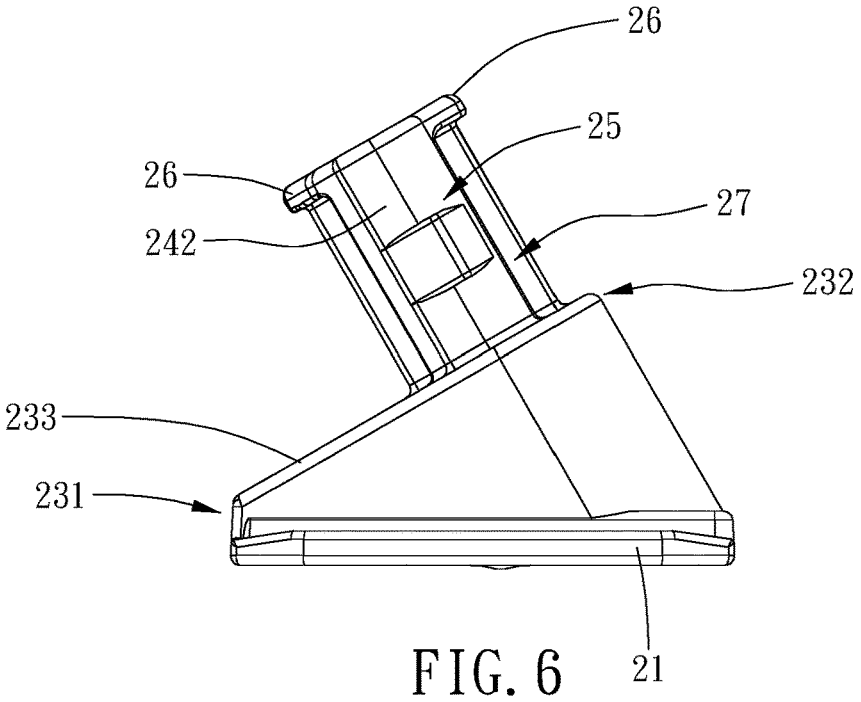
FIG. 6 is a side view of FIG. 5.
Figure 7:
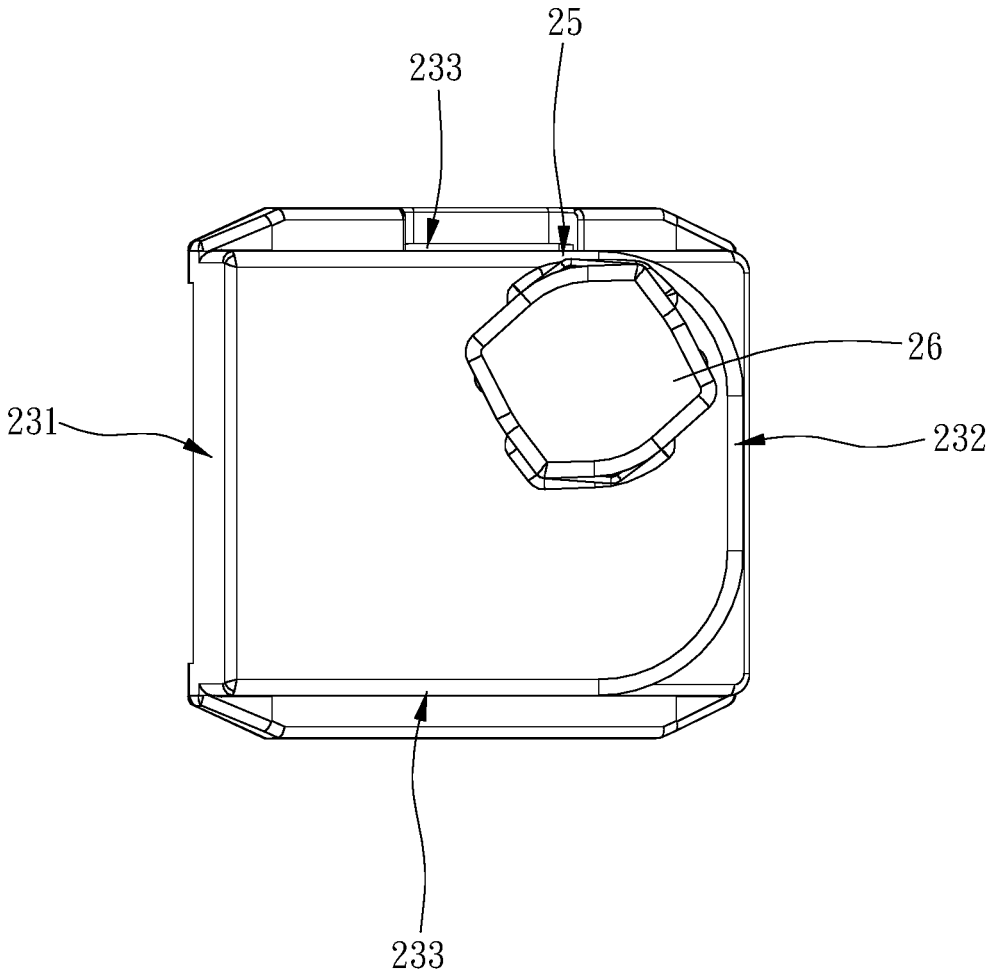
FIG. 7 is a top view of FIG. 5.

Please refer to FIGS. 1 to 7 for a preferable embodiment of the present invention. A tool storing device of the present invention includes a base 1 and at least one positioning seat 2.

The base 1 includes a mounting side 11. The at least one positioning seat 2 includes a connecting portion 21, an extension portion 22 and a positioning portion 24, the connecting portion 21 is connected to the mounting side 11, the extension portion 22 is protrusive from the connecting portion 21, the extension portion 22 includes an inclined surface 23 inclined to the mounting side 11, the inclined surface 23 and the mounting side 11 define an included angle 3 therebetween, and the positioning portion 24 is disposed on the inclined surface 23 and configured for assembling of at least one tool 4. Whereby, the tool storing device is capable of storing more tools since the tools are arranged inclined to the mounting side 11 and partially overlap with one another in a direction perpendicular to the mounting side 11, so that less length of the tool storing device is required.

The included angle 3 ranges from 15 degrees to 60 degrees (preferably 30 degrees), which provides large storing capacity and less thickness.

Preferably, the at least one positioning seat 2 is movably disposed on the mounting side 11, for easy adjustment and/or mounting/dismounting of the at least one positioning seat 2.

In this embodiment, the at least one positioning seat includes a plurality of positioning seats 2, the extension portion 22 is a triangle body, the positioning portion 24 is columnar and protrusive from the inclined surface 23 for assembling of the tool 4 by male-female connection or the like.

The positioning portion 24 includes a column 241 and at least one positioning block 25, the column 241 is disposed on the inclined surface 23, the at least one positioning block 25 is protrusive from at least one sidewall 242 of the column 241, and when the tool 4 is assembled to the column 241, the at least one positioning block 25 is radially engaged with the at least one tool 4.

Preferably, the column 241 includes at least one room 27 for improving resilient deformation of the at least one sidewall 242.

Preferably, the positioning portion 24 further includes at least one blocking portion 26, and the at least one blocking portion 26 is dispose on the column 241 and radially protrusive from the column 241. In an axial direction of the column 241, the at least one blocking portion 26 and the at least one positioning block 25 do not overlap with each other and are located at different heights. When assembling the tool 4, the column 241 is inserted through a hole 41 of the tool 4 where the at least one blocking portion 26 passes through the hole 41 and the at least one positioning block 25 in located within the hole 41, and the at least one tool 4 is then turned about the column 241 so that the at least one positioning block 25 is abutted against an inner wall of the hole 41 and so that the at least one tool 4 is axially blocked by the at least one blocking portion 26.

Preferably, the at least one positioning block 25 includes a first inclined section 251 and a second inclined section 252 connected to each other, a junction 253 of the first inclined section 251 and the second inclined section 252 is the highest than any other point on the first inclined section 251 and the second inclined section 252 relative to the at least one sidewall 242 of the column 241, an inclination of the first inclined section 251 is smaller than an inclination of the second inclined section 252, and an extent of the first inclined section 251 is larger than an extent of the second inclined section 252. During rotation of the tool 4, the inner wall of the hole 41 relatively slides along and passes over the junction 253 of the first inclined section 251 and the second inclined section 252 so that the inner wall of the hole 41 is stably urged by the second inclined section 252.

In this embodiment, the at least one positioning block 25 includes two positioning blocks 25, the at least one blocking portion 26 includes two blocking portions 26, the two blocking portions 26 are located on a top of the column 241, and the two positioning blocks 25 are located at a middle portion of the column 241. The inclined surface 23 is quadrilateral, the inclined surface 23 includes a first side portion 231, a second side portion 232 and two third side portions 233, the first side portion 231 and the second side portion 232 are separately arranged, the two third side portions 233 are separately arranged, the first side portion 231 is more adjacent to the mounting side 11 than the second side portion 232, the two third side portions 233 are transversely connected to the first side portion 231 and the second side portion 232, and the positioning portion 24 is located between the second side portion 231 and one of the two third side portions 233.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A tool storing device, including:

a base, including a mounting side; and at least one positioning seat, including a connecting portion, an extension portion and a positioning portion, the connecting portion being connected to the mounting side, the extension portion being protrusive from the connecting portion, the extension portion including an inclined surface inclined to the mounting side, the inclined surface and the mounting side defining an included angle therebetween, the positioning portion being disposed on the inclined surface and configured for assembling of at least one tool;

wherein the positioning portion is columnar and protrusive from the inclined surface;

wherein the positioning portion includes a column and at least one positioning block, the column is disposed on the inclined surface, the at least one positioning block is protrusive from at least one sidewall of the column, and when the at least one tool is assembled to the column, the at least one positioning block is radially engaged with the at least one tool;

wherein the positioning portion further includes at least one blocking portion, and the at least one blocking portion is dispose on the column and radially protrusive from the column; in an axial direction of the column, the at least one blocking portion and the at least one positioning block do not overlap with each other and are located at different heights; when assembling the at least one tool, the column is inserted through a hole of the at least one tool where the at least one blocking portion passes through the hole and the at least one positioning block in located within the hole, and the at least one tool is then turned about the column so that the at least one positioning block is abutted against an inner wall of the hole and so that the at least one tool is axially blocked by the at least one blocking portion;

wherein the at least one positioning seat is movably disposed on the mounting side; the inclined surface includes a first side portion, a second side portion and two third side portions, the first side portion and the second side portion are separately arranged, the two third side portions are separately arranged, the first side portion is more adjacent to the mounting side than the second side portion, the two third side portions are transversely connected to the first side portion and the second side portion and the positioning portion is located between the second side portion and one of the two third side portions; the at least one positioning block includes a first inclined section and a second inclined section connected to each other, a junction of the first inclined section and the second inclined section is the highest than any other point on the first inclined section and the second inclined section relative to the at least one sidewall of the column, an inclination of the first inclined section is smaller than an inclination of the second inclined section, and an extent of the first inclined section is larger than an extent of the second inclined section; the column includes at least one room; the included angle ranges from 15 degrees to 60 degrees; the at least one positioning seat includes a plurality of positioning seats; the extension portion is a triangle body; the inclined surface is quadrilateral; the at least one positioning block includes two positioning blocks, the at least one blocking portion includes two blocking portions, the two blocking portions are located on a top of the column, and the two positioning blocks are located at a middle portion of the column; the included angle is 30 degrees.

* * * * *